US006575124B2

(12) United States Patent
Shimizu et al.

(10) Patent No.: US 6,575,124 B2
(45) Date of Patent: Jun. 10, 2003

(54) CYLINDER BLOCK OF MULTI-CYLINDER ENGINE AND PROCESS OF MOLDING SAME

(75) Inventors: Yutaka Shimizu, Osaka (JP); Takefumi Uehara, Osaka (JP); Shuichi Yamada, Sakai (JP); Masahiro Aketa, Sakai (JP)

(73) Assignee: Kubota Corporation, Osaka (JP)

( * ) Notice: Subject to any disclaimer, the term of this patent is extended or adjusted under 35 U.S.C. 154(b) by 131 days.

(21) Appl. No.: 09/797,837

(22) Filed: Mar. 5, 2001

(65) Prior Publication Data

US 2002/0121250 A1 Sep. 5, 2002

(51) Int. Cl.[7] ..... F02F 1/14
(52) U.S. Cl. ..... 123/41.79; 123/193.2
(58) Field of Search ..... 123/41.79, 193.2

(56) References Cited

U.S. PATENT DOCUMENTS

| | | | | |
|---|---|---|---|---|
| 4,693,294 A | | 9/1987 | Albrecht et al. | |
| 4,767,801 A | * | 8/1988 | Suzuki et al. | 523/145 |
| 5,562,073 A | | 10/1996 | Van Bezeij et al. | |
| 5,669,339 A | | 9/1997 | Yukawa et al. | |
| 5,957,103 A | | 9/1999 | Takami et al. | |

FOREIGN PATENT DOCUMENTS

| | | |
|---|---|---|
| JP | 8-319881 | 12/1996 |
| JP | 9-32629 | 2/1997 |
| JP | 9-119340 | 5/1997 |
| JP | 9-177599 | 7/1997 |
| JP | 9-177600 | 7/1997 |
| JP | 9-177601 | 7/1997 |
| JP | 11-188454 | 7/1999 |
| JP | 2000-130252 | 5/2000 |
| JP | 2000-130253 | 5/2000 |

* cited by examiner

*Primary Examiner*—Noah P. Kamen
(74) *Attorney, Agent, or Firm*—Bacon & Thomas, PLLC

(57) ABSTRACT

A cylinder block for multi-cylinder engine includes a cooling water passage provided at a head-side portion of a cast metal inter-bore wall. The cooling water passage includes a plurality of vertically adjoining transverse water passages provided in vertical and multiple stages. A connecting wall portion of the cooling water passage includes at least one cast metal connecting wall connecting a front wall portion of the inter-bore wall to a rear half wall portion thereby separating the vertically adjoining transverse water passages from each other. The cooling water passage has its cast metal wall surface which faces a water passage spaced exposed in its entirety as a molded surface. The cooling water passage further includes a pair of left and right rising water passages to permit cooling water flowing within a left and right cylinder jacket of the block that is introduced into the cooling water induction portions to flow into the cooling water passage and thence upwardly out of the block via the rising water passages to circulate in a head jacket located above the block. Left and right cylinder head tightening boss portions having under surfaces are provided, and cooling water induction portions are arranged in proximity to the under surfaces of the boss portions.

9 Claims, 6 Drawing Sheets

CYLINDER BLOCK OF MULTI-CYLINDER ENGINE AND PROCESS OF MOLDING SAME

BACKGROUND OF THE INVENTION

1. Field of the Invention

The present invention relates to a cylinder block of a multi-cylinder engine, and in particular a cooling water passage arrangement for such engine.

2. Explanation of Related Art

According to a technique proposed up to now, a spacing between adjacent cylinder bores is narrowed in order to make the multi-cylinder engine compact and light. Or a cylinder bore is formed larger than the conventional one to reduce the thickness of a wall between adjacent bores as much as possible so as to increase the exhaust amount in an attempt to enhance the output of the engine. Further, the proposed technique forms a cooling water passage within the wall between adjacent bores. For example, FIGS. 7 to 9 show a conventional technique proposed by an Assignee of the invention of the present application. Here, FIG. 7 is a vertical sectional view of a cooling water passage formed within a wall between adjacent bores, which is an essential part of a multi-cylinder block. FIG. 8 is a perspective view of a cylinder jacket core. FIG. 9(A) is a perspective view of a water passage forming member made of metal sheets. FIG. 9(B) is a plan view showing the water passage forming member filled with molding sand. FIG. 9(C) is a front view showing the water passage forming member filled with molding sand.

The conventional technique was disclosed, for example, in Japanese Patent Public Disclosure No. 8-319881. As shown in FIG. 7, a water passage forming member 110 made of metal sheets is embedded at a head side portion of an inter-bore wall 4 of a multi-cylinder block 1 by a molding process to form a cooling water passage 10. The metal sheet water passage forming member 110 comprises two molded metal sheet members joined to each other by welding or caulking as shown in FIG. 9(A).

The cooling water passage 10 comprises a pair of left and right rising water passages 12,12 having lower portions provided with cooling water induction portions 13,13, respectively, and a plurality of transverse water passages 15,15 provided in vertical and multiple stages for mutually communicating these rising water passages 12,12 as shown in FIG. 7. Cooling water within left and right cylinder jackets 8,8 is introduced from the cooling water induction portions 13,13 to a head jacket 22 through the transverse water passages 15,15 and the rising water passages 12,12 to thereby cool the head side portion of the inter-bore wall 4. A portion 11 of the water passage forming member 110 which does not form the cooling water passage 10 is welded to form a non-hollow portion. The metal sheet water passage forming member 110 is embedded into the inter-bore wall 4 by a molding process in the following manner.

As shown in FIGS. 9(B) and 9(C), there is preliminarily prepared a water passage forming member 110 filled with molding sand, which is attached to a position corresponding to an inter-bore wall of a jacket forming mold (not shown). The jacket forming mold is filled with molding sand under pressure by a core making machine to make a jacket core 30 as shown in FIG. 8. As such, the metal sheet water passage forming member 110 is integrated into the core 30. The metal sheet water passage forming member is employed because the conventional molding sand has insufficient flowability, filling ability and transverse rupture strength, and therefore is not suitable for forming the cooling water passage 10.

Next, the jacket core 30, a crank bore core (not shown), a cam balancer core (not shown) and the like are attached to a cylinder block forming metal mold (not shown), into which molten metal is poured. Then after the molten metal has been cooled, the sand is removed to finish the molding of the multi-cylinder block. As such, the metal sheet water passage forming member 110 is embedded into the inter-bore wall 4 by the molding process to form within the inter-bore wall 4 the cooling water passage 10 which communicates the cylinder jackets 8 with the head jacket 22.

SUMMARY OF THE INVENTION

According to the conventional technique, the metal sheet water passage forming member 110 is embedded into the inter-bore wall 4 by a molding process. This entails the following problems.

The jacket core 30 is different from the metal sheet water passage forming member 110 in expansion coefficient, which sometimes results in causing the jacket core 30 to crack and deform after molten metal has been poured.

Further, the metal sheet water passage forming member 110 is apt to insufficiently join with the poured molten metal. This causes the inter-bore wall 4 to distort when working the cylinder bore to result in separating the water passage forming member and ultimately decreasing the cooling effect due to reduction of thermal conduction between the water passage forming member and the inter-bore wall.

An attempt to sufficiently secure the working strength of the inter-bore wall 4 so as to be able to resist the distortion of the cylinder bore caused when working it invites a necessity of increasing the minimum thickness of the inter-bore wall 4. The sectional area of the cooling water passage 10 has to be decreased by an amount corresponding to the increase.

Then prior to the present invention, a trial was conducted to make the water passage forming member core of the molding sand which has been used up to now. But this molding sand is non-spherical and has a large spacing between sand particles to provide a bad filling ability and a weak mutual shape-retaining force. In consequence, in order to secure a strong mutual shape-retaining force and a desired transverse rupture strength, there is a need of enlarging the percentage content of a binder in the molding sand.

However, when the molding sand to make the water passage forming core has the percentage content of the binder enlarged, during the step of pouring the molten metal, if the binder vaporizes and splashes, it increases the generation of gas with the result of being apt to produce mold cavities. In addition, the water passage forming core has a smaller mass and calorific capacity than the other parts. Therefore, when the binder has vaporized and splashed, it extremely loses its shape-retaining force to collapse or the like due to pouring pressure and overheat, which eventually results in forming no water passage and causing, so-called, sand residue. In consequence, the molding sand is involved by the molding material and is seized onto the molded surface and the like to produce unuseful concave and convex portions which narrow the water passage. Additionally, water scale deposits on the concave and convex portions of an inner surface of the water passage to reduce the cooling efficiency.

The present invention provides a technique to form a cooling water passage by using a water passage forming core which is made of core sand to be mentioned later, instead of the conventional metal sheet water passage forming member, and has the following objects:

1. To solve the cracking or the like of a jacket forming core, attributable to the difference of expansion coefficient;
2. To solve a disadvantage of distorting the inter-bore wall when working the cylinder bore or the like;
3. To solve the problem of separation caused by the conventional technique and to enhance the cooling effect of the inter-bore wall;
4. To sufficiently secure the working strength of the cylinder bore and the sectional area of the cooling water passage; and
5. To solve the above-mentioned disadvantage which occurs when the water passage forming core is made of the conventionally used molding sand and to make a water passage forming core large in transverse rupture strength with a binder added in a small amount, thereby forming a highly accurate cooling water passage.

A cylinder block of a multi-cylinder engine as set forth in claim 1 has the following basic construction.

The multi-cylinder engine (E) has an inter-bore wall 4 whose head side portion is provided with a cooling water passage 10 having its molded surface disclosed. This cooling water passage 10 comprises a pair of left and right rising water passages 12,12 having lower portions provided with cooling water induction portions 13,13, respectively, and a plurality of transverse water passages 15 provided in vertical and multiple stages so as to communicate these rising water passages 12,12 with each other. Cooling water within left and right cylinder jackets 8,8 is introduced from the cooling water induction portions 13,13 into the cooling water passage 10 and then is flowed into a head jacket 22.

The invention has the following characteristic construction in order to accomplish the foregoing objects.

In the cylinder block of the multi-cylinder engine having the above-mentioned basic construction, there is provided between vertically adjoining transverse water pages 15, 15 a connecting portion 4*b* which connects a front half wall portion 4*c* of the inter-bore wall 4 to a rear half wall portion 4*d* thereof. The connecting portion 4*b* separates the vertically adjoining transverse water passages 15, 15 from each other. The cooling water passage 10 has its cast metal wall surface which faces a water passage space exposed in its entirety as a molded surface.

The invention is also characterized in that a molded surface of the cooling water passage 10 defines a portion of a wall surface of a cylinder jacket of the engine, and in that the portion of the wall surface of the cylinder jacket and the walls of the cooling passage are formed by casting metal around and against a water passage forming core made of sphered particle sand.

The invention forms a pair of left and right cylinder head tightening boss portions 5,5 in continuity with left and right opposite side portions of a head side portion 4*a* of the inter-bore wall 4 and arranges the cooling water induction portions 13, 13 in proximity to under surfaces of the boss portions, 5, 5, thereby vertically enlarging their openings and spreading them forwardly and rearwardly along with cylinder external peripheral surfaces 3*b*, 3*b*.

The invention also contemplates a process of molding a cylinder block of a multi-cylinder engine comprises making a jacket core 30 so as to form cylinder jackets 8 of the multi-cylinder engine (E), attaching the jacket core 30 to a cylinder block forming mold 28, and pouring molten metal into the cylinder block forming mold 28.

The process uses a water passage forming core (31) of sphered particle sand having a lower expansion coefficient than the common silica sand, the core (31) being intended for forming at a head side portion of an inter-bore wall (4) of the multi-cylinder engine (E), a cooling water passage (10) which communicates the cylinder jackets (8) with a head jacket (22), and, prior to pouring the molten metal, it fixedly attaches the water passage forming core (31) to a position corresponding to the inter-bore wall (4) of the jacket core (30).

FUNCTION AND EFFECT OF THE INVENTION (a) According to the invention, in the cylinder block of the multi-cylinder engine having the foregoing basic construction, there is provided between vertically adjoining transverse water passages 15, 15 a connecting portion 4*b* which connects a front half wall portion 4*c* of an inter-bore wall 4 and a rear half wall portion 4*d* thereof to thereby separate the vertically adjoining transverse water passages 15, 15 from each other. This solves a disadvantage that the jacket core cracks or deforms due to the difference of expansion coefficient. This disadvantage was caused by the prior art which forms the water passage by embedding the metal sheet water passage forming member into the molding material.

(b) According to the invention as set forth in claim 1, the connecting portion 4*b* which connects the front half wall portion 4*c* of the inter-bore wall 4 and the rear half portion 4*d* thereof serves as a rib to reinforce the inter-bore wall 4 having the cooling water passage 10. This can solve another disadvantage that the inter-bore wall is distorted or the like when working the cylinder bore.

(c) The invention does not interpose the metal sheet water passage forming member. This solves the problem of separating the water passage forming member to result in enhancing the cooling effect of the inter-bore wall.

(d) The invention sets the height (H) of every transverse water passage 15 larger than the height (h) of the connection portion 4*b*. This can secure the sectional area of the cooling water passage sufficiently while obtaining the strength against the distortion of the cylinder bore caused when working it.

(e) According to the invention, in the cylinder block of the multi-cylinder engine, each transverse water passage 15 has a width (W) in a front and rear direction, set to between not less than ⅓ of a minimum thickness (T) of the inter-bore wall 4 and not more than ⅔ of the minimum thickness (T) and has a height (H) set to between not less than twice the height (h) of the connecting portion 4*b* and not more than three times the height (h). This can enlarge the sectional area of the cooling water passage much more to result in further enhancing the cooling effect of the inter-bore wall.

(f) In the cylinder block of the multi-cylinder engine, the invention forms a pair of left and right cylinder head tightening boss portions 5, 5 in continuity with left and right opposite side portions of a head side portion 4*a* and arranges a pair of left and right cooling water induction portions 13, 13 in proximity to under surfaces of the boss portions 5, 5. This can vertically enlarge openings of the cooling water induction portions 13, 13 toward the left and right cylinder jackets 8, 8. Beneath the boss portions 5, 5 the cylinder jackets 8, 8 are wide enough to flow the cooling water well. Accordingly, the cooling water within the cylinder jackets 8, 8 readily flows into the cooling water induction portions 13, 13 vertically and largely opened toward the cylinder jackets 8, 8. Besides, the openings of the induction portions 13, 13 are spread forwardly and rearwardly along the cylinder external peripheral surfaces 3*b*, 3*b*. Therefore, the cooling water smoothly flows along the cylinder external surfaces 3*b* to enter from the cooling water induction portions 13, 13 vertically and largely opened toward the cylinder jackets 8, 8 in a large amount. Then it passes through the cooling water passages 15 and the jacket communication passages 12, 12 to the head jacket 22 positioned above the inter-bore wall 4. Meanwhile, it strongly cools the head side portion 4*a*. This remarkably improves the cooling efficiency.

(g) According to the invention, in a process of molding the cylinder block of the multi-cylinder engine which has the foregoing basic construction, a water passage forming core (31) is made of sphered particle sand having a lower expansion coefficient than the common silica sand. The core (31) is intended for forming at a head side portion of an inter-bore wall (4) of the multi-cylinder engine (E), a cooling water passage (10) which communicates the cylinder jackets (8) with a head jacket (22). The sphered particle sand has an excellent flowability and filling ability. With a binder added in a small amount, it can make a water passage forming core having a large transverse rupture strength to result in the possibility of forming a highly accurate cooling water passage.

More specifically, when the water passage forming core is made of the conventionally used non-spherical molding sand, the non-spherical molding sand has so large a spacing between sand particles that it is not well filled and provides a weak mutual shape-:retaining force. Therefore, in order to secure a strong mutual shape-retaining force and a desired transverse rupture strength, a binder must be contained in the molding sand at a higher percentage. On the other hand, with the water passage forming core containing a binder at a higher percentage, during the molten metal pouring step, if the binder vaporizes and splashes, it emits more gas, which results in being apt to produce mold cavities at the spaces where the evaporative emission is made.

Besides, in the case where the water passage forming core which has a smaller mass and calorific capacity than the other parts is made of the conventional molding sand, when the binder has vaporized and splashed, it extremely loses its mutual shape-retaining force to collapse or the like due to pouring pressure and overheat and eventually to form no water passage and cause, so-called, sand residue. Therefore, the molding sand is involved by the molding material and is seized onto the molded surface and the like to produce unuseful concave and convex portions on an inner surface of the water passage, which narrow the water passage. Furthermore, water scale deposits on the concave and convex portion on the inner surface of the water passage to invite the reduction of the cooling efficiency.

On the other hand, the present invention has made the water passage forming core 31 of sphered particle sand having a lower expansion coefficient than the common silica sand. This sphered particle sand can secure the mutual shape-retaining force and the transverse rupture strength of the sand mold with a less binder content and prevent the seizing of the molding sand onto the molded surface. More specifically, it reduces the spacing between sand particles to largely improve its filling ability and strengthen the mutual shape-retaining force. In consequence, this can greatly decrease the percentage content of the binder to secure the mutual shape-retaining force and the desired transverse rupture strength. Along with this fact, even if the percentage content of the binder is 2.5% at weight ratio, the transverse rupture strength is increased to result in the possibility of forming a water passage forming core having such a high strength as the transverse rupture strength of 150 $Kgf/cm^2$, which was considered difficult with the conventional non-spherical molding sand. In other words, even if the percentage content of the binder is largely reduced, it is possible to secure a sufficient mutual shape-retaining force and transverse rupture strength.

The water passage forming core 31 made of the sphered particle sand contains a binder in a small amount. Accordingly, at the molten metal pouring step, when the binder vaporizes and splashes, it emits less gas. This solves the problem of producing gaps and mold cavities at the portion where the evaporative emission is made. Further, even if the binder vaporizes and splashes, the molding sand has so strong a mutual shape-retaining force that it does not collapse nor cause, so-called, sand residue. In consequence, the molding sand is hardly involved by the molding material and is seldom seized onto the molded surface and the like to solve the disadvantage of narrowing the water passage and remove the deposit of water scale. In short, it is possible to form a highly accurate cooling water passage by using a water passage forming core which is made of sphered particle sand and has a transverse rupture strength large enough to be hardly broken.

(h) The invention fixedly attaches the water passage forming core 31 to a position corresponding to the inter-bore wall of the jacket core 30 prior to pouring the molten metal and therefore the cooling water passage 10 is formed with the water passage forming core 31. This solves the disadvantage of cracking and deforming the jacket core attributable to the difference of expansion coefficient. Such disadvantage was caused by the prior art which forms the water passage through molding the metal sheet water passage forming member embedded into the molding material.

(i) The invention does not interpose the metal sheet water passage forming member to solve the problem of separating the water passage forming member. Further, it can increase the sectional area of the cooling water passage 10 by an amount corresponding to the absence of the metal sheet water passage forming member and therefore can further enhance the cooling effect of the inter-bore wall.

BRIEF DESCRIPTION OF THE DRAWINGS

FIG. 1 shows a cylinder block of a multi-cylinder engine according to an embodiment of the present invention.

FIG. 5 shows a water passage forming core according to the present invention.

FIG. 6 shows water passage forming cores according to the other embodiments of the present invention.

DESCRIPTION OF THE PREFERRED EMBODIMENTS

Hereafter, an embodiment of the present invention is explained based on the drawings.

Figure 1A:
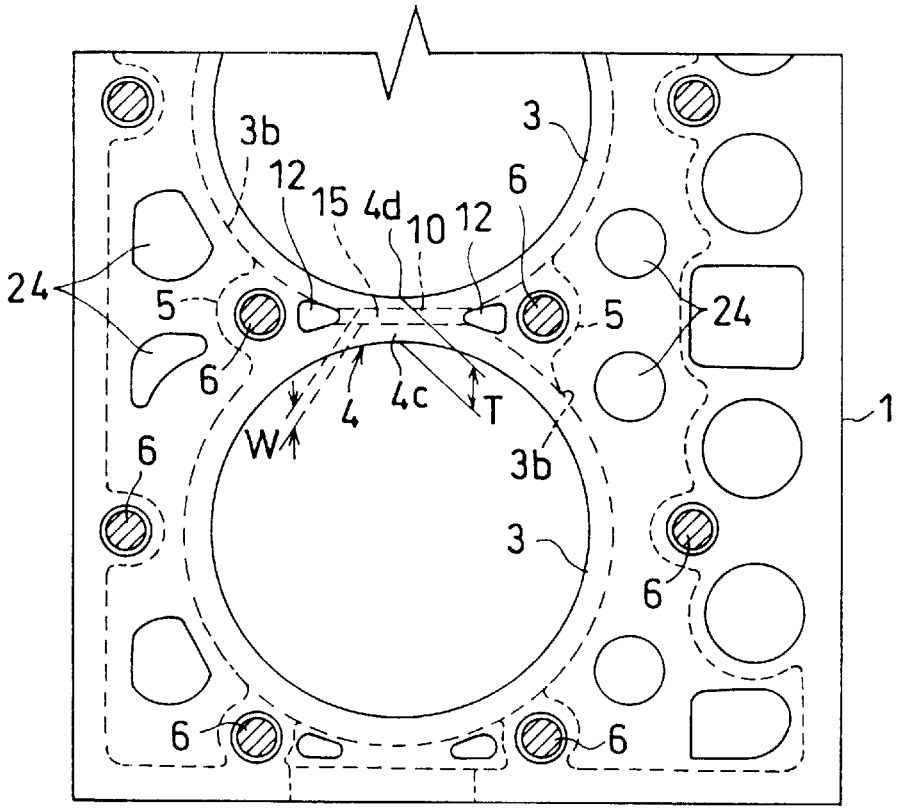
FIG. 1(A) is a partial plan view of the cylinder block.
Figure 1B:
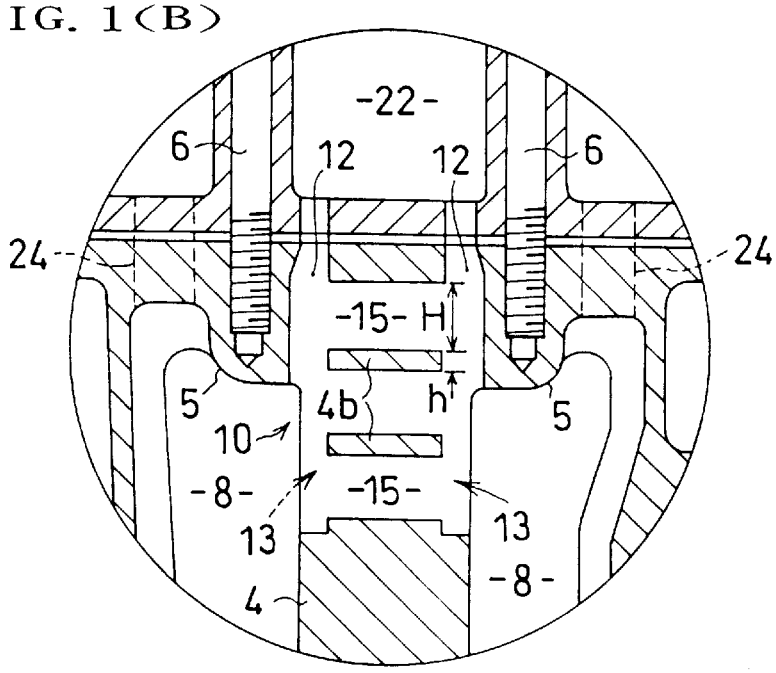
FIG. 1(B) is a vertical sectional view of a cooling water passage formed within an inter-bore wall, which is an essential part of the cylinder block.
Figure 2:
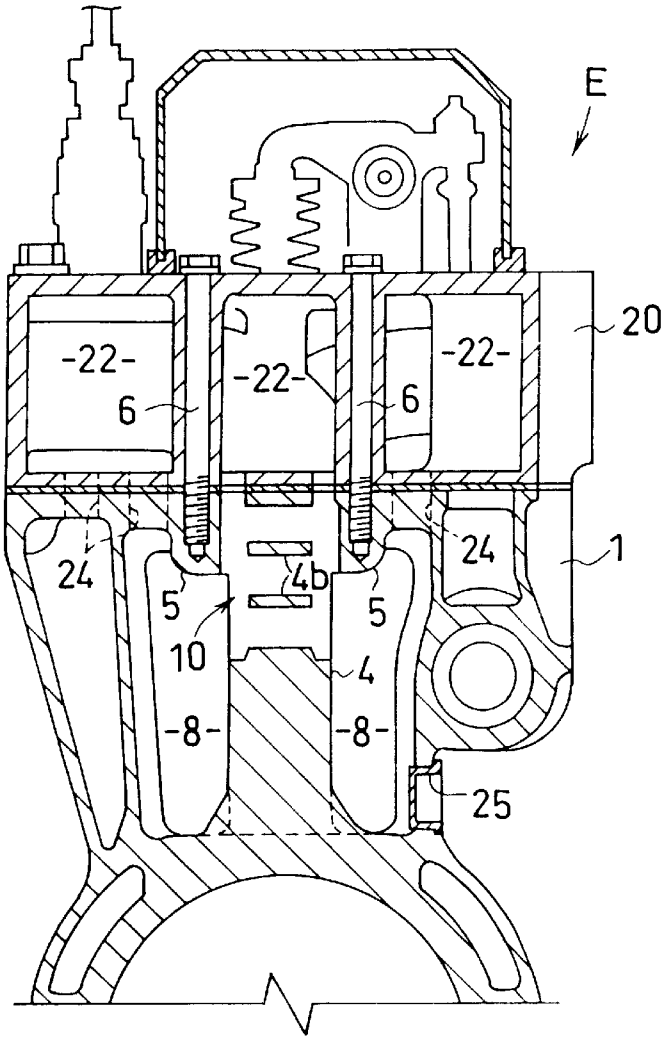
FIG. 2 is a vertical sectional view of an essential part of a vertical multi-cylinder engine provided with a cooling water passage according to the present invention.

FIG. 1(A) is a partial plan view of a cylinder block of a multi-cylinder engine according to the embodiment of the present invention. FIG. 1(B) is a vertical sectional view showing a cooling water passage formed within a wall between adjacent bores, which is an essential part of the cylinder block. FIG. 2 is a vertical sectional view of an essential part of a vertical multi-cylinder engine provided with a cooling water passage according to the present invention.

This vertical multi-cylinder engine (E) comprises a cylinder block 1 formed integrally with a crank case and a cylinder head 20 fixed onto the cylinder block 1 through head bolts 6 as shown in FIG. 2. A cooling water passage 10 formed at a head side portion of an inter-bore wall 4 communicates a head jacket 22 formed within the cylinder head 20 with cylinder jackets 8 formed within the cylinder block 1. The head side portion is strongly cooled by cooling water introduced into the cooling water passage 10 from the cylinder jackets 8.

As shown in FIG. 1(A) and FIG. 2, the cylinder block 1 of the multi-cylinder engine according to the present invention comprises a plurality of cylinders 3 arranged in parallel with each other in a front and rear direction. The cylinders 3,3 adjacent in the front and rear direction are mutually connected through the inter-bore wall 4. The cylinder jackets 8 are formed so as to surround the connected cylinders 3. The head side portion of the inter-bore wall 4 is provided with the cooling water passage 10 shown in FIGS. 1(A) and 1(B) as well as in FIG. 2.

As shown in FIG. 1(B), the cooling water passage 10 comprises a pair of left and right rising water passages 12,12 having lower portions provided with cooling water induction portions 13,13, respectively, and three transverse water passages 15 provided in vertical three stages so as to communicate these rising water passages 12,12 with each other. Cooling water within left and right cylinder jackets 8,8 is introduced from the cooling water induction portions 13,13 to flow into the head jacket 22 through the cooling water passage 10, thereby strongly cooling the head side portion of the inter-bore wall 4.

Hereafter, explanation is given for a process of molding a multi-cylinder block which has the cooling water passage 10.

Figure 5A:
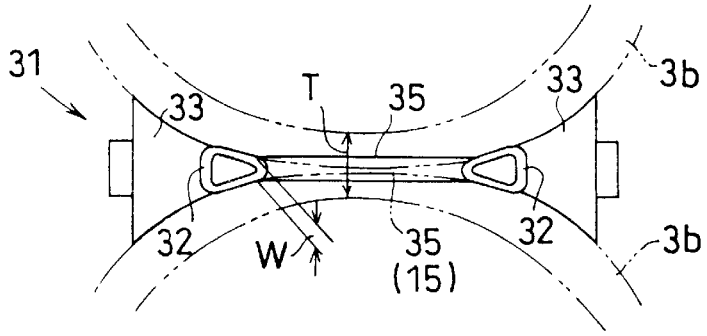
FIG. 5(A) is a plan view of the water passage forming core.
Figure 5B:
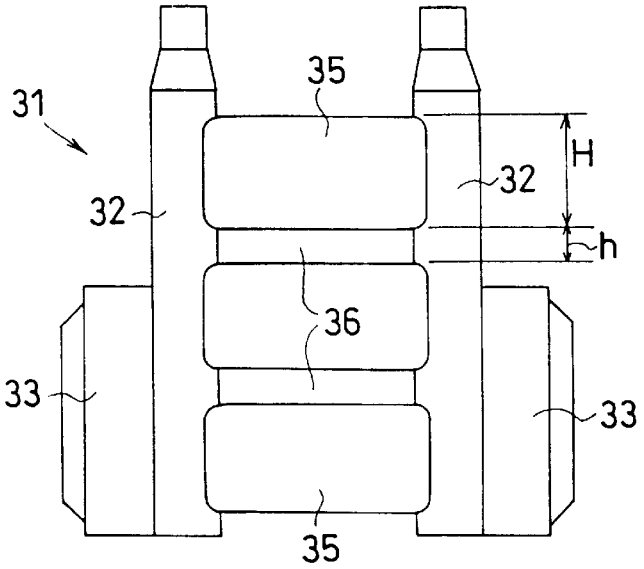
FIG. 5(B) is a front view of the water passage forming core.

Preliminarily made is a water passage forming core 31 as shown in FIGS. 5(A) and 5(B). Here, FIG. 5(A) is a plan view of the water passage forming core 31 and FIG. 5(B) is a front view of the same. This core 31 has a shape corresponding to the cooling water passage 10 and is made of sphered particle sand to be mentioned later, by using a core flask (not shown).

The sphered particle sand has the following characteristics.

First, it is round and has a particle shape close to a precise sphere. Besides, it has an extremely good flowability and filling ability. Additionally, with a binder (thermo-setting resin) added in a small amount, it can produce a high strength (transverse rupture strength).

While the common silica sand has a particle shape coefficient of 1.57, the sphered particle sand has a particle shape coefficient of 1.05. Further, when a binder is added in an amount of 2.2%, the common silica sand affords a transverse rupture strength of 78.7 $Kgf/cm^2$ and on the other hand the sphered particle sand provides a transverse rupture strength of 107.9 $Kgf/cm^2$.

Second, having a smaller thermal expansion coefficient than the common silica sand, it does not crack nor deform to result in making a highly accurate water passage forming core. As for the thermal expansion coefficient when the temperature rises to a range of 400 degrees C. to 1000 degrees C., it is 1.25% in the case of the common silica sand and on the other hand it is 0.4% in the case of the sphered particle sand. Third, it collapses well after the molten metal has been poured to facilitate the removal of sand.

The foregoing characteristics of the sphered particle sand have made it possible to form the cooling water passage 10 by using the water passage forming core 31 instead of the conventional metal sheet water passage forming member. This results in the cooling water passage having its cast metal wall surface which faces a water passage space to be exposed in its entirety as a molded surface.

Figure 4A:
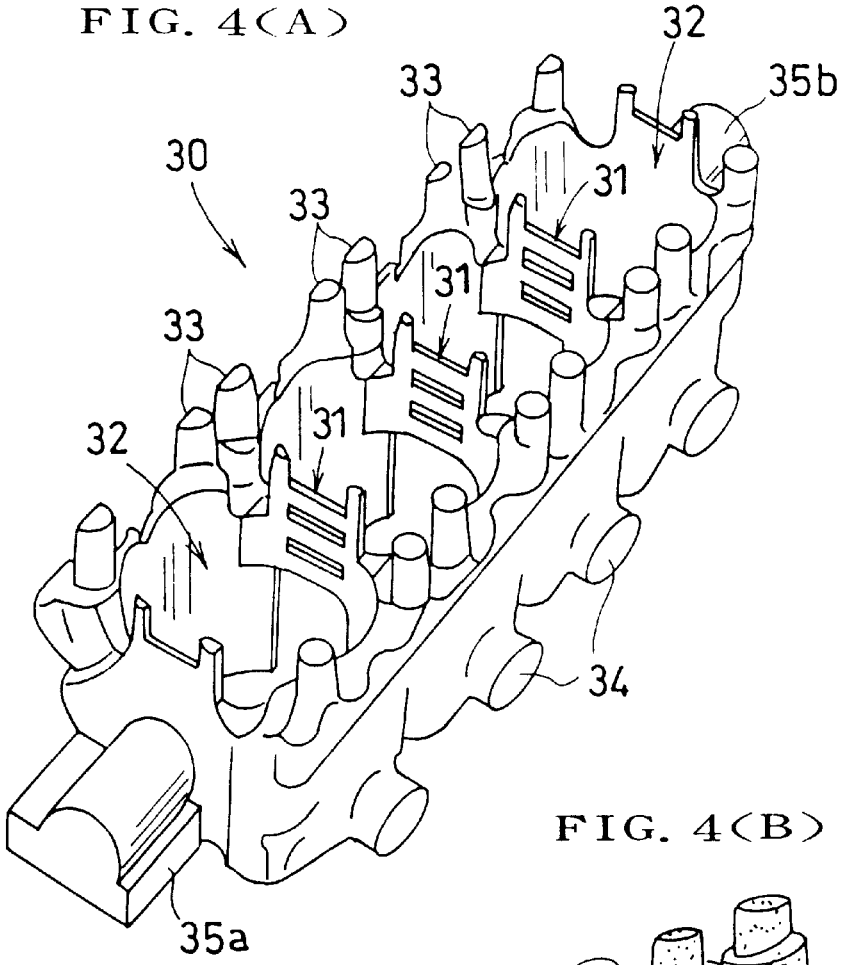
FIG. 4(A) is a perspective view of a cylinder jacket core according to the present invention and FIG. 4(B) is a perspective view of a crank bore core.
Figure 4B:
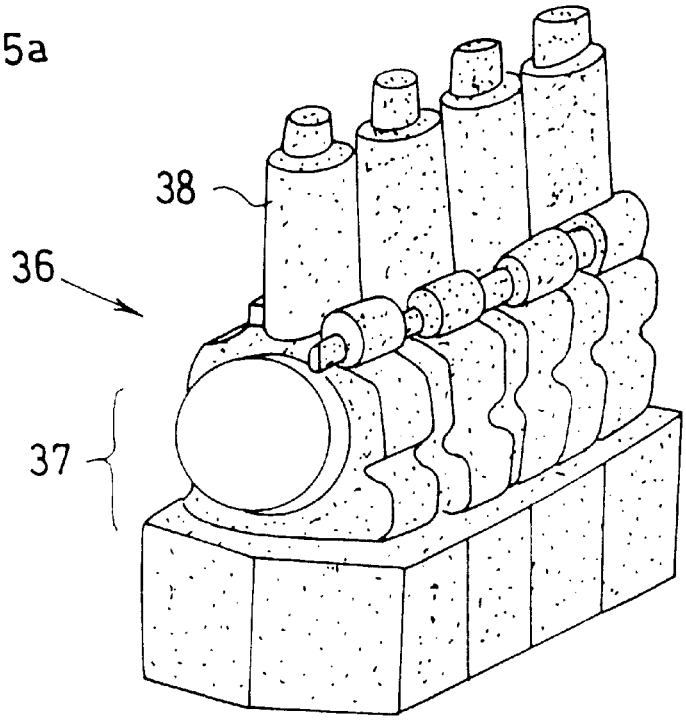

Next, the water passage forming core 31 is attached to every position corresponding to an inter-bore wall of a jacket forming metal mold (not shown). The jacket forming metal mold is filled under pressure with general molding sand by a core making machine (not shown) to make a cylinder jacket core 30 as shown in FIG. 4(A). As such the water passage forming core 31 is integrated into the cylinder jacket core 30. In FIG. 4(A) numeral 32 indicates a cylinder counterpart. Numeral 33 designates a portion corresponding to a jacket communication passage which communicates the cylinder jackets 8 with the head jacket 22. Numeral 34 indicates a portion corresponding to a plug bore which also serves as a bore for removing sand. Numerals 35*a* and 35*b* show portions through which cooling water flows into and out of the cylinder jackets 8, respectively. A bore counterpart 38 of a crank bore core 36 as shown in FIG. 4(B) is inserted into and attached to every cylinder counterpart 32 of the cylinder jacket core 30.

Figure 3:
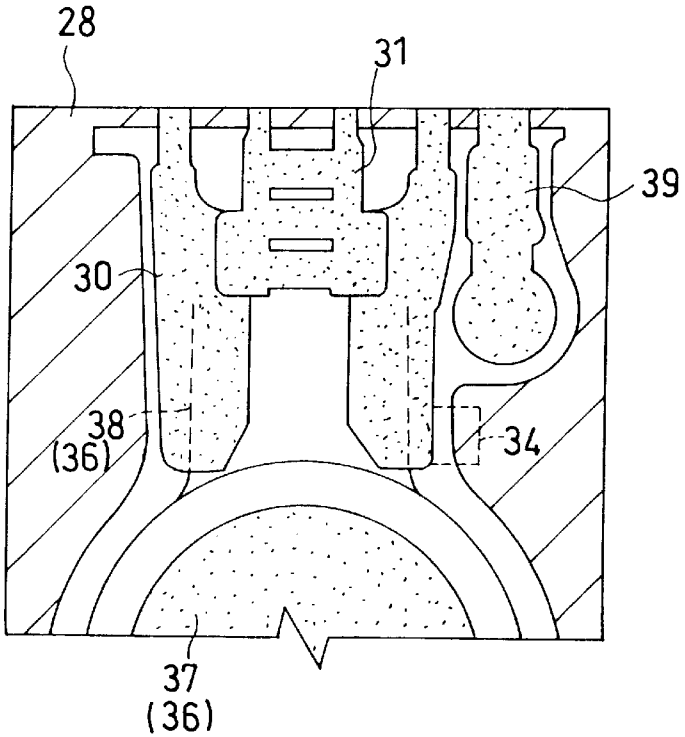
FIG. 3 is a vertical sectional view of an essential part of a cylinder block forming metal mold with a cylinder jacket core, a crank bore core and the like attached thereto.

Subsequently, as shown in FIG. 3, the cylinder jacket core 30, the cylinder bore core 36 (see FIG. 4(B)), a cam balancer core 39, and the like are inserted into and attached to a cylinder block forming metal mold 28. Molten metal is poured into hollow portions within the cylinder block forming metal mold 28. And after the molten metal has been cooled, the sand is removed through a plug bore 25 to finish the molding of the multi-cylinder block 1. In this manner, the water passage forming core 31 forms within the inter-bore wall 4 of the multi-cylinder block 1 the cooling water passage 10 which communicates the cylinder jackets 8 with the head jacket 22.

As shown in FIG. 5(B), the water passage forming core 31 has a shape corresponding to the cooling water passage 10. It comprises a pair of left and right rising water passage counterparts 32,32, three transverse water passage counterparts 35 provided in vertical three stages so as to mutually connect the rising water passage counterparts 32,32, and a pair of left and right cooling water induction portion counterparts 33,33 provided under the rising water passage counterparts 32,32. Hollow portions 36 are formed between vertical transverse water passage counterparts 35,35.

Each of the hollow portions 36 is intended for forming a connecting portion 4*b* which connects a front half wall portion 4*c* of the inter-bore wall 4 to a rear half wall portion 4*d* thereof in FIG. 1(A) (see FIG. 1(B)). The connecting portion 4*b* separates vertically adjoining transverse water passages 15 from each other. This enables the connecting portion 4*b* to serve as a rib for reinforcing the inter-bore wall 4 provided with the cooling water passage 10 and solves the disadvantage of distorting the inter-bore wall 4 when working the cylinder bore or the like.

As shown in FIGS. 5(A) and 5(B), the water passage forming core 31 includes the transverse water passage counterparts 35 each of which has a height (H) set larger than a height (h) of every hollow portion 36. This increases the transverse rupture strength of every transverse water passage counterpart 35 of the core 31 and sufficiently secures the sectional area of the cooling water passage while obtaining a strength against the distortion of the cylinder bore caused when working it by setting the height (H) of every transverse water passage 15 larger than the height (h) of the connecting portion 4*b*.

In this embodiment, the transverse water passage counterpart 35 has a width (W) in a front and rear direction. The width (W) is set to between not less than ⅓ of a minimum thickness (T) of the inter-bore wall 4 and not more than ⅔ of the minimum thickness (T). And its height (H) is set to between not less than twice the height (h) of the hollow portion 36 and not more than three times the height (h). Therefore, every transverse water passage 15 has the width (W) in the front and rear direction set to between not less than ⅓ of the minimum thickness (T) of the inter-bore wall 4 and not more than ⅔ of the minimum thickness (T). And its height (H) is set to between not less than twice the height (h) of the connecting portion 4*b* and not more than three times the height (h). This can enlarge the sectional area of the cooling water passage 10 much more to result in further enhancing the cooling effect of the inter-bore wall 4.

As shown in FIG. 5(A), the paired left and right cooling water induction portion counterparts 33,33 of the core 31 are spread along external peripheral surfaces 3*b*,3*b* of cylinders 3 adjacent to each other in the front and rear direction. This enlarges openings of the cooling water induction portions 13,13 so as to allow a large amount of cooling water to flow from the induction portions 13,13 spread toward the cylinder jackets 8,8 into the cooling water passage 10 with the result of strongly cooling the head side portion 4*a* of the inter-bore wall 4.

Every transverse water passage counterpart 35 of the water passage forming core 31 may be formed in the shape of wedges arranged symmetrical to one another in the left and right direction and each having a front end directed to a mid portion when seen in plan as shown by an imaginary line in FIG. 5(A), in an attempt to reduce the thickness of the inter-bore wall 4 as much as possible. This produces an advantage of decreasing a pitch between adjacent cylinder bores or increasing a diameter of a cylinder bore much more to result in the possibility of enhancing the exhaust amount and eventually the output.

As shown in FIGS. 1(A) and 1(B), the inter-bore wall 4 is formed in continuity with a pair of left and right cylinder head tightening boss portions 5,5 and the paired left and right rising water passages 12,12 are positioned inside the boss portions 5,5. This reduces the spacing between the head bolts 6,6 and tightens the cylinder 3 uniformly and strongly along its peripheral direction by an amount corresponding to the reduction of the spacing. Further, jacket communication holes 24 provided by opening an upper end wall of the cylinder block 1 and the paired rising water passages 12,12 are increased in diameter by forming the inter-bore wall 4 in continuity with the cylinder head tightening boss portion 5,5 to result in presenting an advantage of being able to flow a large amount of cooling water therethrough The pair of left and right cylinder head tightening boss portions 5,5 are formed in continuity with left and right opposite side portions of the head side portion 4*a*. The pair of left and right cooling water induction portions 13,13 are arranged in proximity to under surfaces of the cylinder head tightening boss portions 5,5. This can vertically enlarge openings of the cooling water induction portions 13,13 toward the left and right cylinder jackets 8,8. Beneath the boss portions 5,5, the cylinder jackets 8,8 are wide enough to flow the cooling water well. Accordingly, the cooling water within the cylinder jackets 8,8 readily flows into the cooling water induction portions 13,13 vertically and largely opened toward the cylinder jackets 8,8. Besides, the openings of the induction portions 13,13 are spread forwardly and rearwardly along the cylinder external peripheral surfaces 3*b*,3*b*. Therefore, the cooling water smoothly flows along the cylinder external surfaces 3*b* to enter from the cooling water induction portions 13,13 vertically and largely opened toward the cylinder jackets 8,8 in a large amount. Then it passes through the cooling water passages 15 and the jacket communication passages 12,12 to the head jacket 22 positioned upwards of the inter-bore wall 4. Meanwhile, it strongly cools the head side portion 4*a*. This remarkably improves the cooling efficiency.

Figure 6A:
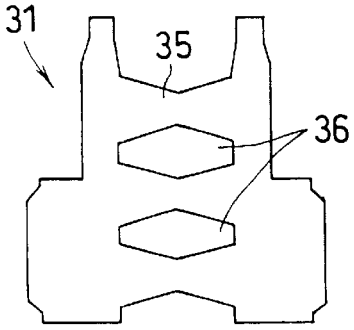
FIG. 6(A) is a front view of a core according to a first modification.
Figure 6B:
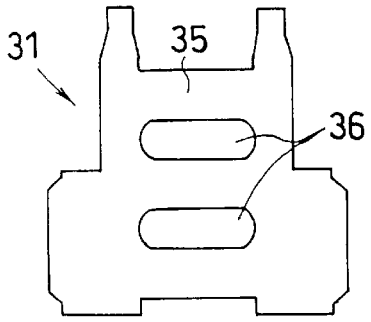
FIG. 6(B) is a front view of a core according to a second modification.
Figure 7:
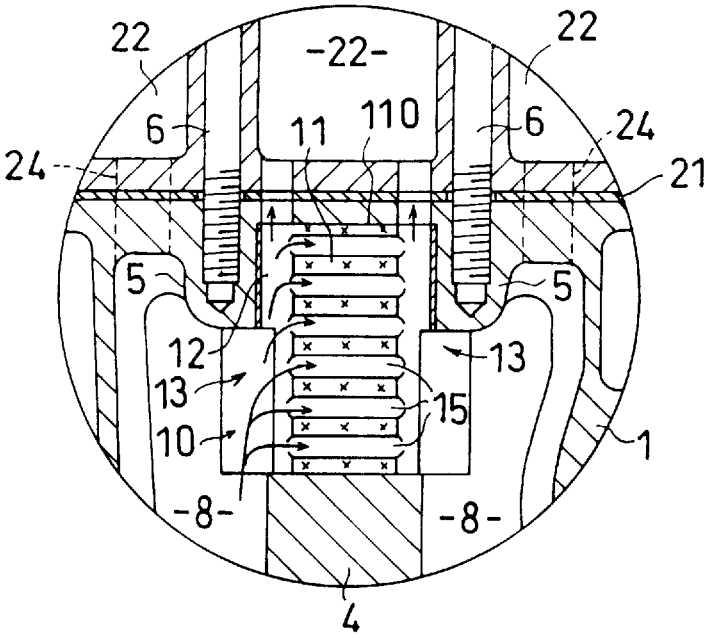
FIG. 7 PRIOR ART
FIG. 7 is a view of prior art and similar to FIG. 1(B)
Figure 8:
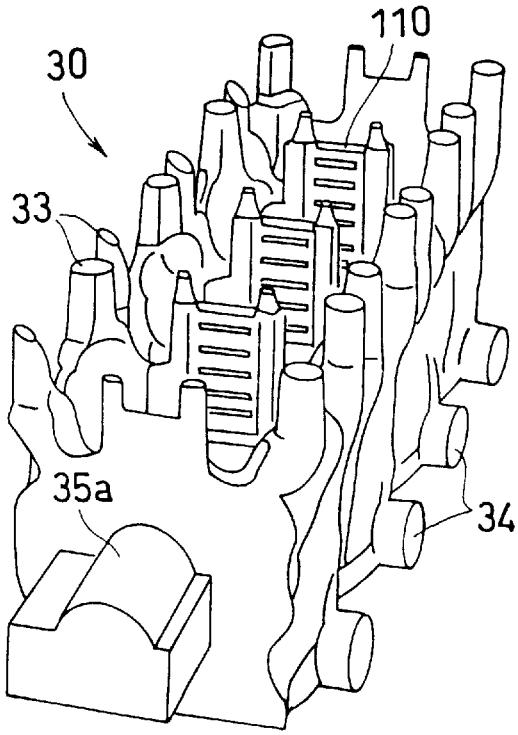
FIG. 8 PRIOR ART
FIG. 8 is a view of the prior art and similar to FIG. 4(A)
Figure 9A:
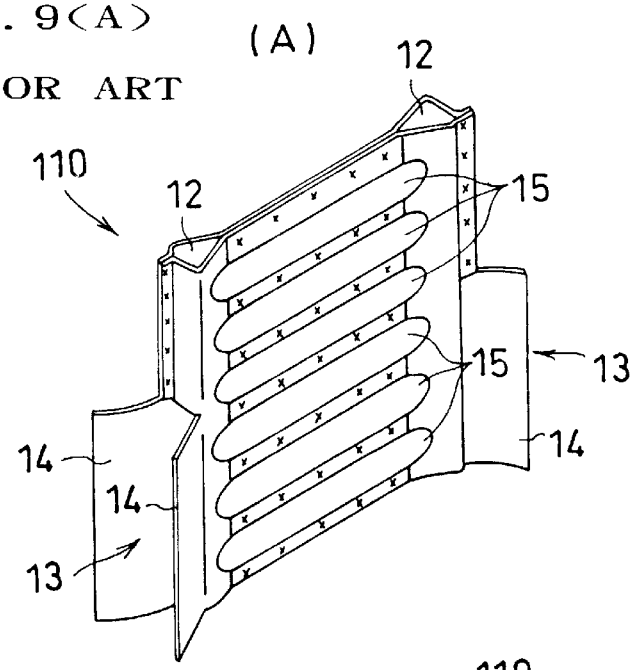
FIG. 9(A) PRIOR ART
FIG. 9(A) is a perspective view of a metal sheet water passage forming member according to the prior art.
Figure 9B:
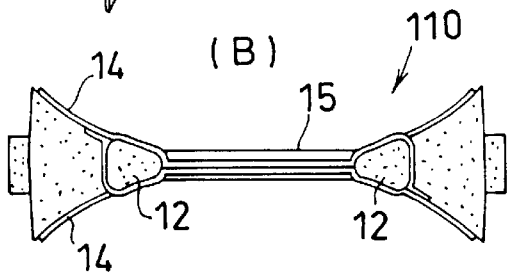
FIG. 9(B) PRIOR ART
FIG. 9(B) is a plan view showing the water passage forming member filled with molding sand.
Figure 9C:
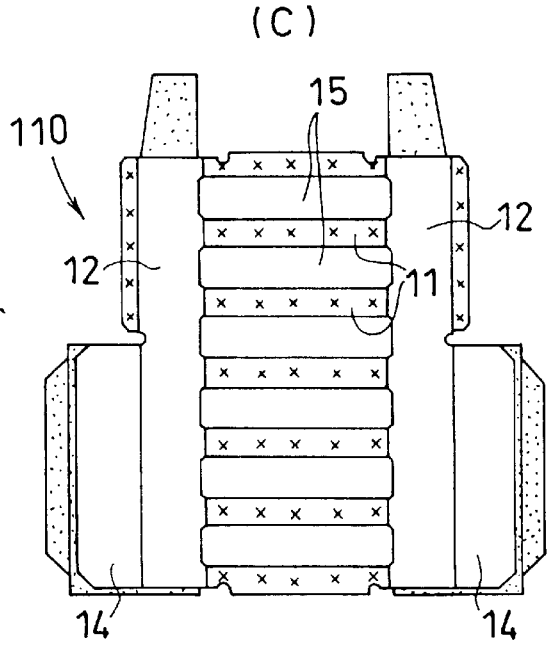
FIG. 9(C) PRIOR ART
FIG. 9(C) is a front view showing the water passage forming member filled with molding sand.

FIGS. 6(A) and 6(B) show water passage forming cores according to modifications of the present invention. FIG. 6(A) is a front view of a core according to a first modification. FIG. 6(B) is a front view of a core according to a second modification. In the first modification of FIG. 6(A), each transverse water passage counterpart 35 has an upper edge inclined upwards and outwards in both of the left and right directions and has a lower edge inclined downwards and outwards in both of the right and left directions. On the other points, it is constructed in the same manner as in the foregoing embodiment (FIG. 5). This allows water vapor to move upwards along the upper edge of each cooling water passage 15 inclined upwards and to escape into the head jacket 22 through the rising water passages 12, even if the cooling water boils within every transverse water passage 15 to produce the vapor. As a result, the cooling efficiency is kept high.

In the modification of FIG. 6(B), every hollow portion 36 is formed in the shape of an ellipse. On the other points, it is constructed in the same manner as in the foregoing embodiment (FIG. 5). This attempts to smoothly flow the cooling water by forming the connecting portion 4*b*, which is provided at a position corresponding to the hollow portion 36 and separates the respective transverse water passages from each other, in the shape of the ellipse.

According to the foregoing embodiment and modifications, the head side portion of the inter-bore wall 4 can be strongly cooled to result in strongly cooling a piston ring through a cylinder wall. This can bring a top ring near a piston top surface as far as possible and extremely decrease a ring-like dead space produced around an external periphery of a piston top, which does not contribute to combustion, in an attempt to improve the rate of utilizing air.

This can also solve the problem of sticking the top ring due to the carbonization of unburnt fuel. Besides, along with bringing the top ring near the piston top surface as far as possible, the position of the piston pin can be brought near the piston top surface as much as possible. A crank shaft can swing in a length increased by an amount corresponding to that approach to result in the possibility of attaining a relative downsizing without changing the height of a connecting rod engine, and increasing the exhaust amount by enlarging the piston stroke.

In addition, the head side portion of the inter-bore wall 4 can be strongly cooled. This can enlarge the diameter of the cylinder bore in an attempt to increase the exhaust amount. Besides, as for a multi-cylinder engine or the like loaded with a turbo-charger, when the present invention is applied to it, the engine can be relatively downsized and increase its output. Conversely, in the case where the piston stroke is not changed, as the position of the piston pin is brought nearer the piston top surface, the connecting rod can be elongated by an amount corresponding to that approach and therefore the piston side pressure can be decreased, which results in the reduction of frictional loss.

The above embodiment has exemplified a process wherein a water passage forming core 31 is attached to every position corresponding to an inter-bore wall of a jacket forming metal mold (not shown) and the jacket forming metal mold is filled under pressure with general molding sand by a core making machine (not shown) to make a cylinder jacket core 30. But the present invention is not limited to the process. More specifically, the cylinder jacket core 30 may be preliminarily made with the jacket forming metal mold. The water passage forming core 31 may be fixedly attached to every position corresponding to an inter-bore wall of the jacket core 30. In short, it is sufficient if, prior to pouring the molten metal, the water passage forming core 31 is fixedly attached to every position corresponding to an inter-bore wall of the jacket core 30.

What is claimed is:

1. A cylinder block for a multi-cylinder engine, said block comprising a cooling water passage (10) provided at a head side portion of a cast metal inter-bore wall;

said cooling water passage (10) comprising a plurality of vertically adjoining transverse water passages (15, 15) provided in vertical and multiple stages;

a connecting wall portion **(4*b*) defined by at least one cast metal connecting wall which connects a front half wall portion (4*c*) of the inter-bore wall (4) to a rear half wall portion (4*d*) thereof located between the vertically adjoining transverse water passages (15, 15), thereby separating the vertically adjoining transverse water passages (15, 15)** from each other;

the cooling water passage (10) having its cast metal wall surface which faces a water passage space exposed in its entirety as a molded surface;

the cooling water passage (10) further comprising a pair of left and right rising water passages (12, 12) having lower portions provided with cooling water induction portions (13, 13), said transverse water passages (15, 15) communicating the rising water passages (12, 12) with each other so that, cooling water flowing within a left and a right cylinder jacket (8, 8) of the block and introduced into the cooling water induction portions (13, 13) flows into the cooling water passage (10), and thence upwardly out of the block via said rising water passages (12), whereby a head jacket locatable above the block may receive cooling water from the rising water passage (12);

a pair of left and right cylinder head tightening boss portions (5, 5) having under surfaces, and which are monolithic with adjacent cylinder walls (3, 3) and located on left and right opposite side portions of the head side portion **(4*a*) of the inter-bore wall (4); and the cooling water induction portions (13, 13) arranged in proximity to the under surfaces of the boss portions (5, 5), said cooling water induction portions extending over a vertical whole area extending from lower edges of the boss portions (5, 5) to the lowest edge portion of the transverse water passage (15) and extending forwardly and rearwardly along adjacent cylinder jackets (8, 8)** of the block.

2. The cylinder block as set forth in claim 1, wherein the molded surface of the cooling water passage wall is defined by metal that has been cast around a water passage forming core (31) made of sphered particle sand.

3. The cylinder block of a multi-cylinder engine as set forth in claim 1, wherein a molded surface of the cooling water passage (10) defines a portion of the wall surface of a cylinder jacket (8) of the block and only the molded surface of the cooling water passage (10) of the molded surface of the cylinder jacket (8) is defined by metal that has been cast against a water passage forming core (31) made of sphered particle sand.

4. The cylinder block as set forth in claim 1, wherein each of the transverse water passage (15) has a height (H) set larger than a height (h) of the connecting wall portion **(4*b*)**.

5. The cylinder block as set forth in claim 1, wherein each of the transverse water passages (15) has a width (W) in a front and rear direction and has a height (H), the width (W) being set to between not less than ⅓ of a minimum thickness (T) of the inter-bore wall (4) and not more than ⅔ of the minimum thickness (T), the height (H) being set to between not less than twice a height (h) of the connecting wall portion **(4*b*)** and not more than three times the height (h).

6. A cylinder block for a multi-cylinder engine, said block comprising a cooling water passage (10) provided at a head side portion of a cast metal inter-bore wall;

said cooling water passage (10) comprising a plurality of vertically adjoining transverse water passages (15, 15) provided in vertical and multiple stages;

a connecting wall portion **(4*b*) defined by at least one cast metal connecting wall which connects a front half wall portion (4*c*) of the inter-bore wall (4) to a rear half wall portion (4*d*) thereof located between the vertically adjoining transverse water passages (15, 15), thereby separating the vertically adjoining transverse water passages (15, 15)** from each other;

the cooling water passage (10) having its cast metal wall surface which faces a water passage space exposed in its entirety as a molded surface; and each of the transverse water passages (15) which has a width (W) in a front and rear direction and has a height (H), the width (W) being set to between not less than ⅓ of a minimum thickness (T) of the inter-bore wall (4) and not more than ⅔ of the minimum thickness (T), the height (H) being set to between not less than twice a height (h) of the connecting wall portion **(4*b*)** and not more than three times the height (h).

7. The cylinder block as set forth in claim 6, wherein the molded surface of the cooling water passage wall is defined by metal that has been cast around a water passage forming core (31) made of sphered particle sand.

8. The cylinder block of a multi-cylinder engine as set forth in claim 6, wherein a molded surface of the cooling water passage (10) defines a portion of the wall surface of a cylinder jacket (8) of the block and only the molded surface of the cooling water passage (10) of the molded surface of the cylinder, jacket (8) is defined by metal that has been cast against a water passage forming core (31) made of sphered particle sand.

9. The cylinder block as set forth in claim 6, wherein the cooling water passage (10) further comprises a pair of left and right rising water passages (12, 12) having lower portions provided with cooling water induction portions (13, 13), said transverse water passages (15, 15) communicating the rising water passages (12, 12) with each other so that, cooling water flowing within a left and a right cylinder jacket (8, 8) of the block and introduced into the cooling water induction portions (13, 13) flows into the cooling water passage (10), and thence upwardly out of the block via said rising water passages (12), whereby a head jacket locatable above the block may receive cooling water from the rising water passage (12).

* * * * *